United States Patent [19]

Benton, Jr.

[11] 4,048,739

[45] Sept. 20, 1977

[54] VISUAL DISPLAY WITH BACKLIGHTING

[76] Inventor: Lawrence M. Benton, Jr., 1727 N. 34th St., Milwaukee, Wis. 53208

[21] Appl. No.: 604,848

[22] Filed: Aug. 14, 1975

[51] Int. Cl.[2] ..... G09F 13/10

[52] U.S. Cl. ..... 40/106.1; 40/132 D

[58] Field of Search ..... 40/132 D, 106.1, 133 R, 40/132 R; 240/2 AT, 2 D

[56] References Cited

U.S. PATENT DOCUMENTS

| | | | |
|---|---|---|---|
| 3,010,235 | 11/1961 | Roberts et al. | 40/132 D |
| 3,584,401 | 6/1971 | Cryer et al. | 40/132 D |
| 3,616,554 | 11/1971 | Singer et al. | 40/31 |
| 3,892,080 | 7/1975 | Koch | 40/132 D |
| 4,004,360 | 1/1977 | Hammond | 40/106.1 |

*Primary Examiner*—John F. Pitrelli

*Attorney, Agent, or Firm*—Andrus, Sceales, Starke & Sawall

[57] ABSTRACT

An imperforate display membrane is backlit by placing an apertured support between a light source and the display membrane so that the light travels through the support and forms a spot on the membrane at a desired position having display indicia in registration therewith. When a plurality of interchangeable flexible display membranes are to be used, vacuum means are provided to hold the respective membrane in place. The vacuum is provided at the light transmission openings in the support and adjacent the display indicia. Additional vacuum openings may be disposed in the support and which are removed from the light transmission openings and registered indicia.

3 Claims, 2 Drawing Figures

1
2
3
4
5
6
7
8
9
10
11
12
13
16

1
2
3
4
5
6
7
10
11
14
15
16

VISUAL DISPLAY WITH BACKLIGHTING

Prior Art Of Interest

| Prior Art Of Interest | | |
|---|---|---|
| Pat. No. | Inventor | Issue Date |
| 984,512 | McKnight | February 14, 1911 |
| 1,221,494 | Wiley | April 3, 1917 |
| 1,271,817 | Wiley | July 9, 1918 |
| 3,086,306 | Morgan | April 23, 1963 |
| 3,307,819 | Cocito | March 7, 1967 |
| 3,726,033 | Benton, Jr. | April 10, 1973 |

BACKGROUND AND SUMMARY OF THE INVENTION

This invention relates to a visual display with backlighting.

Display devices, such as in the present inventor's above-listed U.S. Pat. No. 3,726,033, often utilize a light mounting technique wherein the light bulbs protrude forwardly from the face of a display surface. In such instances, the display surface must be provided with openings to accommodate the bulbs. In some instances, it is desirable to eliminate the prominence of the light bulbs, and also to eliminate the cost of hole formation in the display surface itself.

The present invention solves the aforementioned problems and utilizes the concept of backlighting an imperforate display membrane which provides the front display surface. This is accomplished by placing an apertured support between the light source and the display membrane so that the light travels through the support and forms a spot on the membrane at a desired position having display indicia in registration therewith.

In addition, when a plurality of interchangeable flexible display membranes are to be used, vacuum means are provided to hold the respective membrane in place. The vacuum is provided at the light transmission openings in the support and adjacent the display indicia. Additional vacuum openings may be disposed in the support and which are removed from the light transmission openings and registered indicia.

BRIEF DESCRIPTION OF THE DRAWING

The accompanying drawing illustrates the best mode presently contemplated by the inventor for carrying out the invention.

In the drawing.

DESCRIPTION OF THE PREFERRED EMBODIMENT

Figure 1:
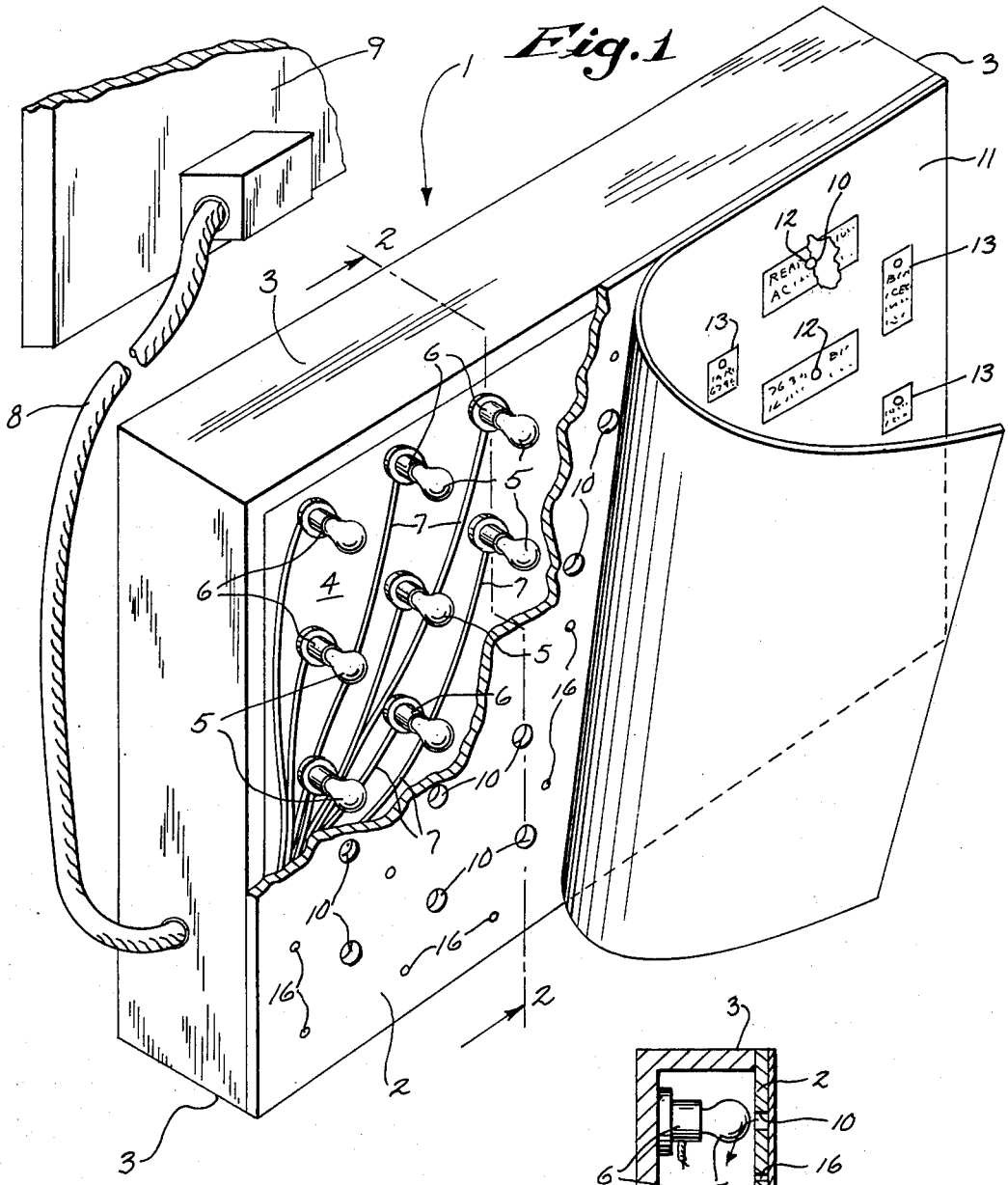
FIG. 1 is a front perspective view of a visual display device constructed in accordance with the invention and with the display membrane folded back for purposes of clarity.
Figure 2:
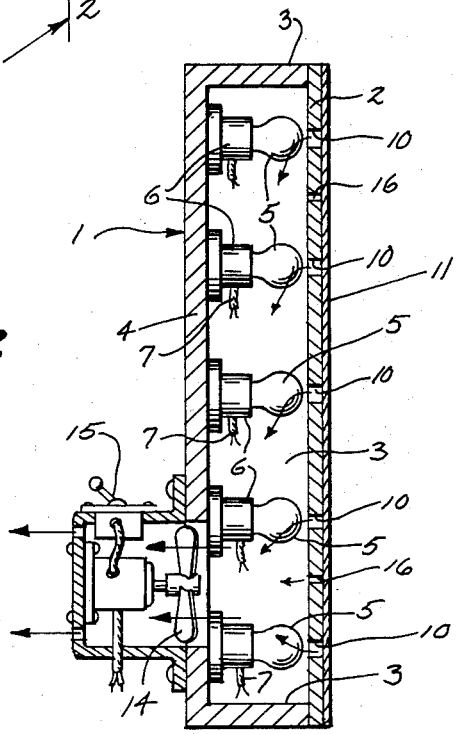
FIG. 2 is an enlarged fragmentary vertical section, taken on line 2—2 of FIG. 1.

As shown in the drawing, the invention is embodied in an enclosed frame-like box 1 having a planular front wall 2, peripheral edge walls 3 and a back wall 4.

The inner face of back wall 4 provides a mounting for a light source which is shown as a plurality of spaced forwardly facing light bulbs 5 mounted in suitable sockets 6 which in turn are connected through wires 7 to a collecting cable 8 and hence to a master control panel 9. Panel 9 may be of the type disclosed in my aforementioned patent wherein one or more bulbs may be selectively actuated at any given time.

Front wall 2 is provided with a plurality of apertures 10, with each aperture disposed directly forwardly of its respective bulb 5. Wall 2 forms a support for a planular visual display surface such as membrane 11 which is mounted thereto as will be hereinafter described. Membrane 11 is imperforate and co-extensive with its support and is light-transmissive.

A plurality of discrete spaced display indicia portions are disposed on the front display face of membrane 11, with at least some of these portions 12 registering with apertures 10. Other portions 13 may comprise textual material for educational purposes or the like.

When panel 9 is actuated to light various bulbs, the light rays emitted therefrom will pass through the adjacent aperture 10 so as to produce a spot of light at the registered indicia 12 on membrane 11. The spot illuminates, only the indicia portion with which the respective lit bulb 9 corresponds. By disposing front support wall 2 between bulbs 5 and membrane 11, the bulbs do not project forwardly of the display and no holes are necessary in the membrane. This latter advantage is of substantial importance when the membrane comprises a thin flexible non-self-supporting film or the like which is removably held to support wall 2 by vacuum means, which will now be described.

An exhaust fan 14 is mounted to back wall 4 in a manner so that when it is actuated as by a switch 15, a negative air pressure is created within the substantially sealed box 1. This causes an internal suction on membrane 11 at apertures 10 to hold the imperforate membrane in place. The apertures thus perform a dual function: that of controlled light transmission and creation of holding pressure at the registered indicia 12.

In some instances, a plurality of additional apertures 16 may be placed in support wall 2 to assist in securing the display membrane. The need for, number and size of such auxiliary apertures will depend on the number and size of primary apertures 10 and the membrane weight. In any event, apertures 16 are disposed remote from bulbs 5, apertures 10 and registered indicia 12 so as not to interfere with them.

The concept of the invention provides an improved electrical visual display which is advantageous in teaching, either with or without an instructor, and for lectures of various types.

Various modes of carrying out the invention are contemplated as being within the scope of the following claims particularly pointing out and distinctly claiming the subject matter which is regarded as the invention.

I claim:

1. A visual display device comprising, in combination:

a. a frame comprising a generally enclosed substantially sealed box, b. a plurality of forwardly extending spaced light emitting members disposed within said box, c. means to selectively actuate said members, d. said box including a support wall disposed forwardly of said light emitting members, e. a display surface disposed on the front of said support wall and co-extensive therewith and with said surface comprising a removable flexible light transmissive imperforate membrane having a plurality of discrete spaced display indicia portions thereon, f. a plurality of light transmitting apertures disposed on said support wall directly forwardly of said light emitting members and behind and in registry with said display indicia so that when said light emitting members are selectively actuated said apertures will controllably transmit the light therefrom to form a spot on said display membrane to illuminate only the indicia portion with which the respective lit member corresponds, g. and means for creating a membrane holding negative air pressure at said light transmission apertures to removably secure said membrane to the front face of said support wall.

2. The visual display device of claim 1 in which said last-named means comprises air exhaust fan means for said box.

3. In the visual display device of claim 2:

a. a plurality of auxiliary apertures in said support wall and disposed remote from said light emitting members as well as from said first-named apertures and registered display indicia, b. said auxiliary apertures assisting in the creation of membrane holding pressure.

* * * * *